US008009021B1

(12) United States Patent
Peters, Jr. et al.

(10) Patent No.: US 8,009,021 B1
(45) Date of Patent: Aug. 30, 2011

(54) EMERGENCY CALL PANEL FOR HOSPITAL COMMUNICATION SYSTEM

(75) Inventors: Charlie Lawrence Peters, Jr., Alamo, CA (US); Paul David Langstroth, Phoenix, AZ (US)

(73) Assignee: West-Com Nurse Call Systems, Inc., Fairfield, CA (US)

( * ) Notice: Subject to any disclaimer, the term of this patent is extended or adjusted under 35 U.S.C. 154(b) by 500 days.

(21) Appl. No.: 12/147,584

(22) Filed: Jun. 27, 2008

(51) Int. Cl.
*G08B 5/22* (2006.01)

(52) U.S. Cl. ..... 340/286.07; 340/286.06

(58) Field of Classification Search ..... 340/286.07, 340/286.06
See application file for complete search history.

(56) References Cited

U.S. PATENT DOCUMENTS

| | | | | |
|---|---|---|---|---|
| 1,081,884 | A | 12/1913 | Bertagnolli | |
| 2,680,842 | A | 6/1954 | Opphile | |
| 2,977,448 | A | 3/1961 | Schneider | |
| 3,597,555 | A | 8/1971 | Gould | |
| 4,967,195 | A | 10/1990 | Shipley | |
| 5,561,412 | A | 10/1996 | Novak et al. | |
| 5,838,223 | A * | 11/1998 | Gallant et al. | 340/286.07 |
| 5,844,488 | A | 12/1998 | Musick | |
| 6,693,514 | B2 | 2/2004 | Perea, Jr. et al. | |
| 7,092,376 | B2 | 8/2006 | Schuman | |
| 7,154,397 | B2 | 12/2006 | Zerhusen et al. | |
| 7,292,135 | B2 | 11/2007 | Bixler et al. | |
| 2007/0273487 | A1 * | 11/2007 | Dawson | 340/286.07 |
| 2008/0204201 | A1 * | 8/2008 | Perkins et al. | 340/286.07 |
| 2009/0153277 | A1 * | 6/2009 | Parker et al. | 335/194 |

* cited by examiner

*Primary Examiner* — Travis R Hunnings
(74) *Attorney, Agent, or Firm* — Malin Haley DiMaggio Bowen & Lhota, P.A.

(57) ABSTRACT

A patient controlled single gang signaling device for use within a hospital communication network. The device contains two actuators, one for initiating an emergency distress call while the other initiates a non-emergency distress call. The emergency distress call actuator is controlled with a pull cord, thus enabling a patient to send out an emergency distress signal from a position away from the unit. The device also includes a third actuator providing the user with the option of terminating the transmission of any message.

29 Claims, 7 Drawing Sheets

EMERGENCY CALL PANEL FOR HOSPITAL COMMUNICATION SYSTEM

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention relates to an emergency signaling device for use in health care institutions, specifically a pull cord operated call panel device.

2. Description of Related Art

In the field of healthcare, proper and effective means of communication are vitally important at all levels. Specifically, communication between patients and the nursing staff is critical to providing optimum patient care. A number of advances have been made to allow for more effective means of connecting patients with the nursing staff. One such advancement is a nurse call system, which uses telecommunication to convey audio messages between patient and the hospital staff. These telecommunication systems were originally developed to utilize a simple point to point communication method accomplished through the use of a patient and nurse telephone.

These nurse call systems have developed into complex communication networks that connect a large number of patients to a number of different members of the nursing staff. Generally, each patient is linked to a nurse call master station. Nurses that are roaming throughout the hospital wing are connected to the nurse call master station through a number of different methods ranging from pagers to the state of the art voice over IP VOCERA communications badge. These roaming nurses are able to address each individual patient's needs, which are transmitted through the nurse call network.

A number of devices and methods are used to initiate the transmission of a patient's message within the nurse call system network. In the simplest form, a telephone or intercom is used to convey the audio message from the actual patient. In other methods, actuators are triggered thus sending a signal representing a specific message or situation to the hospital staff. More complex methods use timers to initiate a call, such as a pain medication reminder, after the passing of a specific time interval.

One of the most common methods of initiating the transmission of a patient's message is through the use of an electrical switch activated with an emergency pull cord. Electrical switch activation through the use of a pull cord has existed in the prior art for nearly a century and has been used in a number of applications. U.S. Pat. No. 1,081,884 issued to E. C. and F. W. Bertognolli describes a cord that is used as a trip wire to activate an electric alarm switch that warns of an intruder. U.S. Pat. No. 2,680,842 issued to Opphile describes a pull cord activated electrical switch that is used to control a flashlight on a fishing rod. In the event that fish bites the line, thus pulling the cord, the flashlight is powered on. U.S. Pat. No. 2,977,448 issued to Schneider and U.S. Pat. No. 3,597,555 issued to Gould both detail an electrical switch that is triggered with a pull cord actuator. Specifically, the triggering of the pull cord actuator completes the electrical circuit, thus allowing current to flow and creating a signal.

Pull cord activated electrical switches, as mentioned previously, are used in hospitals to send a message from a patient to a nurse. Specifically, these pull cords are designed to relay the message that the patient is in an emergency situation and requires immediate assistance from a nurse. Due to the ability of a pull cord to be triggered from the floor, the method is most often used in areas of a hospital where the patient is at risk for falling, such as the bathroom. Pull cord activated emergency alarms are used throughout hospitals. They are used in situations when a patient is in a serious emergency, therefore sending out an alarm to the entire nursing staff. The problem is that often times, a patient needs to make a call from the bathroom that does not signal an emergency situation. One example of this situation is when a patient is finished in the bathroom and needs assistance getting back to bed. Often times, the patient will activate the pull cord, thus sending out an emergency signal to all nursing staff, even though the situation is not an actual emergency.

There is therefore a need for a device and method that is used in the hospital bathroom in conjunction with an emergency pull cord, by which a patient can activate a non-emergency related hospital staff signal.

The present invention overcomes these challenges by creating a single gang emergency call panel that combines an emergency pull cord with a switch that is used to trigger the sending of a non-emergency signal. The device utilizes a compact design allowing it to be mounted in a convenient position on the bathroom wall. Finally, the single gang panel is labeled in a clear and user-friendly manner permitting the easy operation of the device.

BRIEF SUMMARY OF THE INVENTION

The present invention relates to a signaling device for use by patients within a hospital communication system. The device contains two switches that when activated, each initiates the transmission of a different signal within the hospital communications network. One signal is used to convey an emergency distress message, while the other signal represents a non-emergency situation. Transmission of the emergency distress signal is triggered through a switch that is controlled with a pull cord mechanism. The transmission of the non-emergency signal is managed though an actuator that is not a pull cord. This actuator can be but is not limited to a push button.

Both signal switches and means for controlling the switches are contained within a single gang panel that is easily mounted to the wall. The non-emergency signal switch actuator is labeled in a clear manner and illuminated through a light source, which can be but is not limited to a light emitting diode (LED). The triggering of the actuator causes the light source to illuminate, thus showing that a call has been made. The device also includes a call cancel actuator that is used to stop the transmission of either the emergency or non-emergency signal.

The pull cord extends through the front of the call panel to a spring loaded member on the back of the control panel. The spring loaded member is attached at one end to the pull cord and at the other end to a switch. This switch is located on the circuit board and is used to trigger the sending of an emergency message to the hospital staff. The circuit board sits behind and parallel to the control panel face.

The device is configured and coupled within a network as set forth herein, and can also be electronically connected through alternative devices such as dome lights.

Accordingly, it is an object of the present invention to provide a patient signaling device for initiating the transmission of messages to nurses through the hospital communication system.

It is another object of the present invention to provide a patient signaling device that uses a pull cord to trigger the transmission of an emergency message to the nurse staff.

It is still another object of the present invention to provide a patient signaling device that utilizes a user controlled actuator to initiate the transmission of a non-emergency message to the nurse staff.

It is yet another object of the present invention to provide a patient signaling device that combines a pull cord to trigger an emergency message transmission and, an actuator to initiate a non-emergency message transmission in a single gang call panel.

It is another object of the present invention to provide a patient signaling device that initiates either an emergency or non-emergency message within a hospital communication network, which integrates a canceling function that terminates the transmission of the message.

DETAILED DESCRIPTION OF THE INVENTION

Figure 1:
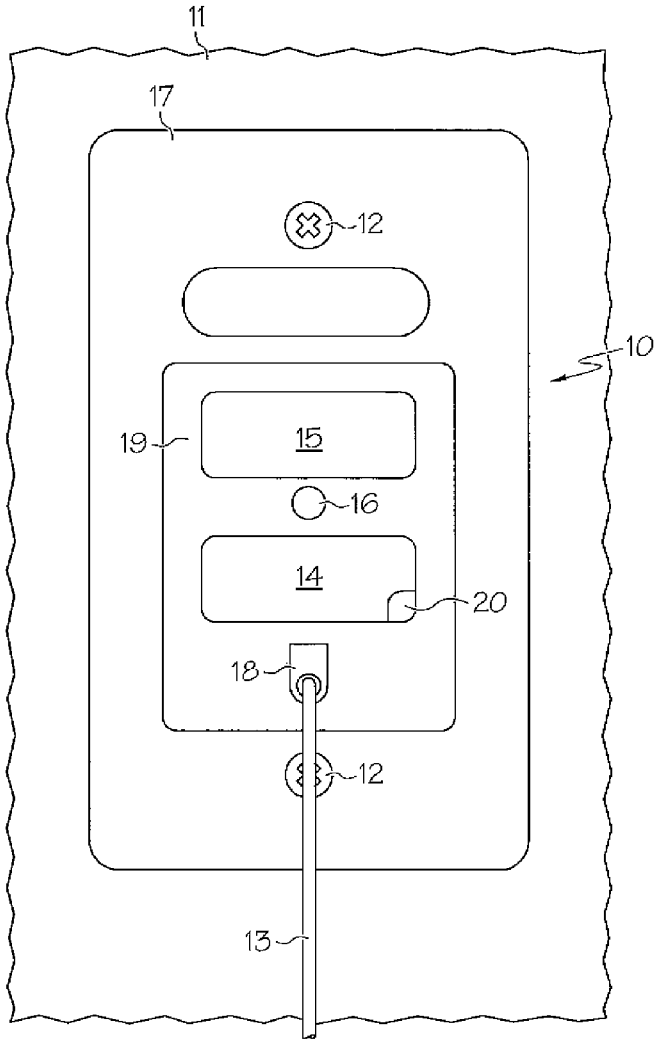
FIG. 1 shows a frontal perspective of the call panel.

Referring to FIG. 1, a front perspective of the call panel device is shown. Specifically, the call panel device 10 is a single gang station that is mounted to the wall 11 through any suitable means, such as but not limited to screws 12. The pull cord 13 extends out of an aperture 18 located on the bottom of the call panel faceplate housing 17. Activation of the pull cord 13 initiates the sending of an emergency message to the nursing staff through the hospital communication system. The pull cord 13 is utilized when a patient is in a dangerous situation such as when a patient is lying on the floor of the bathroom injured. The non-emergency actuator 14 sits on the call panel 10 above the pull cord aperture 18. The non-emergency actuator 14 is used in situations when a patient needs to signal a hospital staff member, but is not in any danger. This non-emergency actuator 14 includes a yellow LED window 20, by which a LED located beneath the window 20 illuminates the actuator 14 once it has been triggered. A LED 16 sits directly above the non-emergency actuator 14. This call panel LED 16 illuminates when pull cord 13 is triggered, thus displaying that a call has been placed. Directly above the LED 14, lies a "cancel" actuator 15, which is used to stop the sending of either an emergency or non-emergency message within the hospital communication network. The "cancel" actuator 15 can be but is not limited to a push-button switch.

The pull cord aperture 18, non-emergency actuator 14, call panel LED 16, and "cancel" actuator, all are located on faceplate membrane 19 that is located within the call panel housing 17. The faceplate membrane 19 is constructed of Lexan® that is finished with a gray coloring. The coloring of the membrane 19 is different from the coloring of the call panel faceplate housing 17, thus distinguishing the placement of the user operated components from the rest of the call panel device 10. The call panel face plate housing 17 is constructed of a fire retardant, high-impact thermoplastic that is suitable for use in hospitals. The pull cord 13 is constructed from a polyurethane phosphorescent material. The phosphorescent properties cause the pull cord 13 to emit light slowly over time, thus creating a means by which the pull cord 13 is seen in low or no light condition without the use of an external lighting source. Furthermore, the use of polyurethane in the composition of the pull cord 13 lowers the amount of bacteria on the cord, thus reducing the risk of an infection. As mentioned previously, the entire call panel device is located within a single gang assembly that is compact. The dimensions can be but are not limited to 4.5 inches tall, 2.75 inches wide, and 1.5 inches thick. The compact design enables the discrete and easy mounting of the call panel device in a variety of different positions.

Figure 2:
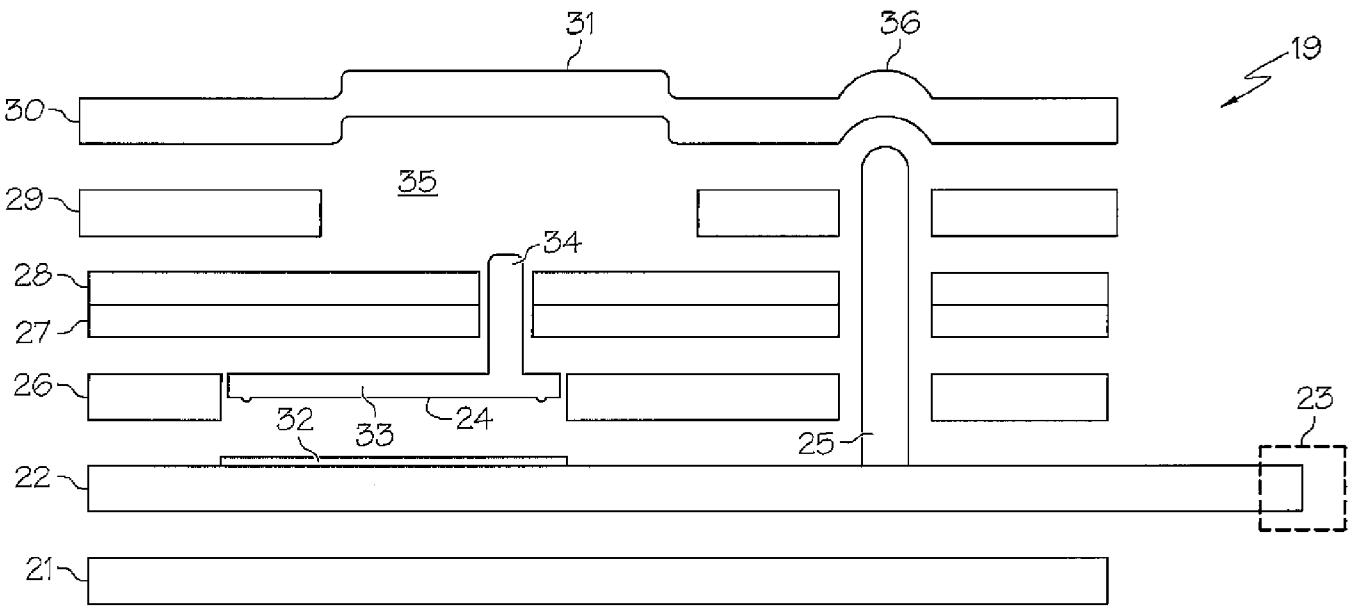
FIG. 2 shows a cross sectional view of the call panel faceplate membrane with a push button actuator.

Referring now to FIG. 2, a cross sectional view of the call panel faceplate membrane 19 including a push button actuator is shown. The push button actuators as stated previously are used to either initiate a non-emergency message within the hospital communication system or cancel the transmission of a message. The structure of the call panel device includes a circuit board 22 that is secured to a back adhesive 21 layer. An electrically conductive layer 32 is located within a specific region on top of the faceplate member circuit board 22. This circuit board 22 is used to provide support to the call panel assembly, to serve as a conductive platform for the bottom of electrical switches, and to allow for an input and output means for the call panel device. The input and output signals are both carried through conductive paths located within the circuit board 22 that are coupled to the network system through a contech connector 23. This contech connector 23 supports eight input and output pins. Along with the conductive layer 32, the faceplate member circuit board 22 also supports at least one LED 25. The LED is used to illuminate the push button switch that initiates the non-emergency distress message.

A circuit spacer layer 26 is stacked on top of the circuit board covering the entire board 22 except for the conductive area 32 and the region where the LED 25 extends upwards. The circuit spacer 26 forms a channel on top of the conductive region 32 of the circuit board 22. The tin armature 24 contains a flat member 33, which extends the entire horizontal distance between the vertical channel walls of the circuit spacer layer. A long monolithically attached pole piece 34 extends vertically upward from the top side of the flat bottom member 33. The flat member 33 moves vertically down in response to a user applied force that is transmitted through the pole piece 34 that extends upward from the flat member 33. The tin armature 24 is electrically conductive and coupled to the input signal. As the flat member 33 moves vertically downward within the channel, it makes contact with the conductive layer 32 on top of the circuit board 22. The flat member 33 acts as an electrical contact and transmits the input signal to the conductive layer 32. The conductive layer 32 is coupled to the output of the circuit through a series of conductive channels.

The input signal is then transmitted through the output and is used to represent either an emergency or non-emergency message. The tin armature 24 in combination with the conductive layer acts as a push-to-make switch. When the flat member 33 is pushed flush against the conductive layer 32, the circuit is completed and current flows, which in turn initiates the sending of a message within the hospital communication system.

A magnetic layer 27 extends horizontally on top of both the circuit spacer layer 26 and the moving flat armature member 33. The armature pole piece 34 and the LED 25 both extend through the magnetic layer. The magnetic layer 27 serves as a recoil mechanism by using magnetic forces to pull the flat member 33 of the tin armature away from the conductive layer 32. Separating the tin armature 24 away from the conductive member stops the flow of current and the subsequent sending of a message to the hospital staff. A dome retainer layer 28 extends horizontally on top of the magnetic layer 27 such that the tin armature pole piece 34 and LED 25 both extend through the dome retainer layer 28. This dome retainer layer 28 is used to separate the top structural layers of the call panel device 10 from the magnetic layer 27. An overlay space layer 29 sits on top of the dome retainer layer 28 such that the overlay space layer 29 does not cover the entire top of the dome retainer layer 28. This in turn creates a push button chamber 35 within which the end of the armature pole piece 34 rests when the armature is not in electrical contact with the conductive layer 32. An overlay material layer 30 covers the entire stacked structure. The overlay material layer 30 consists of a push button embossed section 31 and an LED embossed section. The push button embossed section 31 extends over the push button chamber 35 and is deformed into the chamber during user operation. This deformation causes the overlay material to engage the armature pole piece 34 and displace the entire armature 24 vertically, thus activating the switch.

Figure 3:
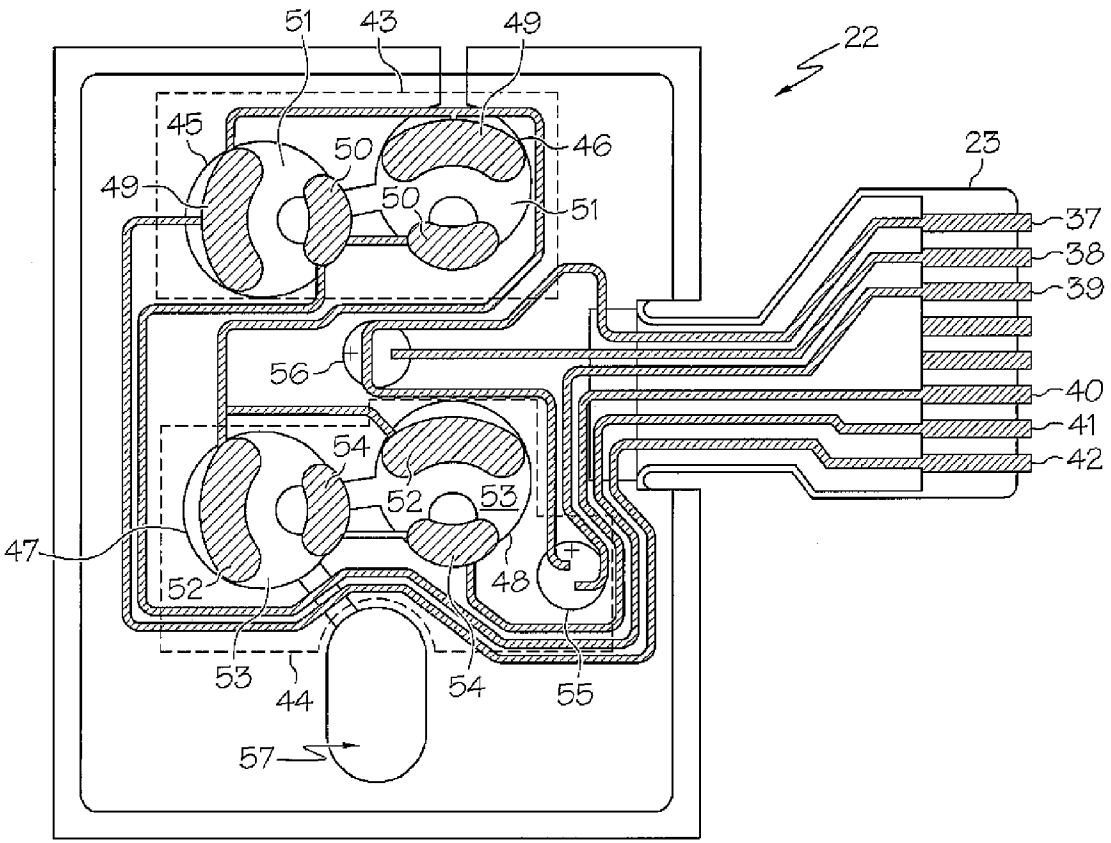
FIG. 3 shows a top view of the call panel faceplate membrane circuit board.

FIG. 3 shows a top view of the call panel faceplate membrane circuit board 22. The contech connector 23 extends out from the side of the circuit board 22 containing 8 input/output (I/O) connections formed through conductive channels. The circuit board consists of the corresponding circuitry for the upper actuator 43 and the corresponding circuitry for a lower actuator 44. The upper actuator is used to cancel an emergency or non-emergency call, while the lower actuator is used to initiate a non-emergency message. The upper actuator circuitry 43 consists of two push button switches 45 and 46. Both push button switches contain a kidney shaped upper actuator input electrical contact 49 that extends into each armature aperture 51. The armature aperture 51 is the same circular shape as the flat member of the tin armature. Both upper actuator input electrical contacts are coupled to the first input pin 42 through an electrically conductive channel. A smaller kidney shaped upper actuator output electrical contact 50 extends into the armature aperture on the opposing side of the input electrical contact 49. Both upper actuator output electrical contacts 50 are connected through a conductive channel to the circuit board upper actuator output pin 41. Triggering of the upper actuator causes the displacement of the tin armature within the armature aperture 51, such that the tin armature connects the input electrical contacts 49 with the output electrical contacts 50. This connection in turn allows current to flow between the input and output contacts 50, thus sending the input signal from the input pin 42 to the upper aperture output pin 41.

The lower actuator circuitry 44 consists of two push button switches 47 and 48. Both push button switches contain a kidney shaped lower actuator input electrical contact 52 that extends into each armature aperture 53. The input electrical contact 52 is coupled to the faceplate member circuit board input pin 42 through an electrically conductive channel. Two smaller kidney shaped lower actuator output electrical contacts 54 extend into each armature aperture 53 on the opposing end of the input electrical contact 52. The output electrical contacts are both coupled to the lower actuator output pin 40 through an electrically conductive channel. The activation of the lower actuator causes the flat member of the armature to displace such that it is touching both the input electrical contact 52 and the output electrical contact 54. This arrangement completes the circuit and allows current to flow between the import and output electrical contacts 52 and 54. This current flow transmits a signal from the faceplate member circuit board input pin 42 and the lower actuator output pin 40 corresponding to a non-emergency message. The lower actuator circuitry also contains a LED 55 that is used to illuminate the lower actuator when it is triggered. The anode of the LED 55 is connected to the LED input 37 through an electrically conductive channel. The cathode of the LED 55 is connected to the cathode terminal pin 39 also through an electrically conductive channel.

The faceplate membrane circuit board 22 consists of not only the upper and lower actuator circuitry 43 and 44, but also a LED 56 that extends out of the center of the faceplate membrane. The center LED is illuminated only for the emergency level call. Additionally, at power up both the LEDs are illuminated as a visual test. The anode of the center LED 56 is connected to the input pin 37 through a conductive channel, while the cathode is connected to the center LED cathode terminal pin 38 though a conductive channel. A pull cord opening 57 sits at the bottom of the membrane circuit board 22 beneath the lower aperture circuitry 44. The pull cord is threaded through the pull cord opening to the back of the call panel device.

Figure 4:
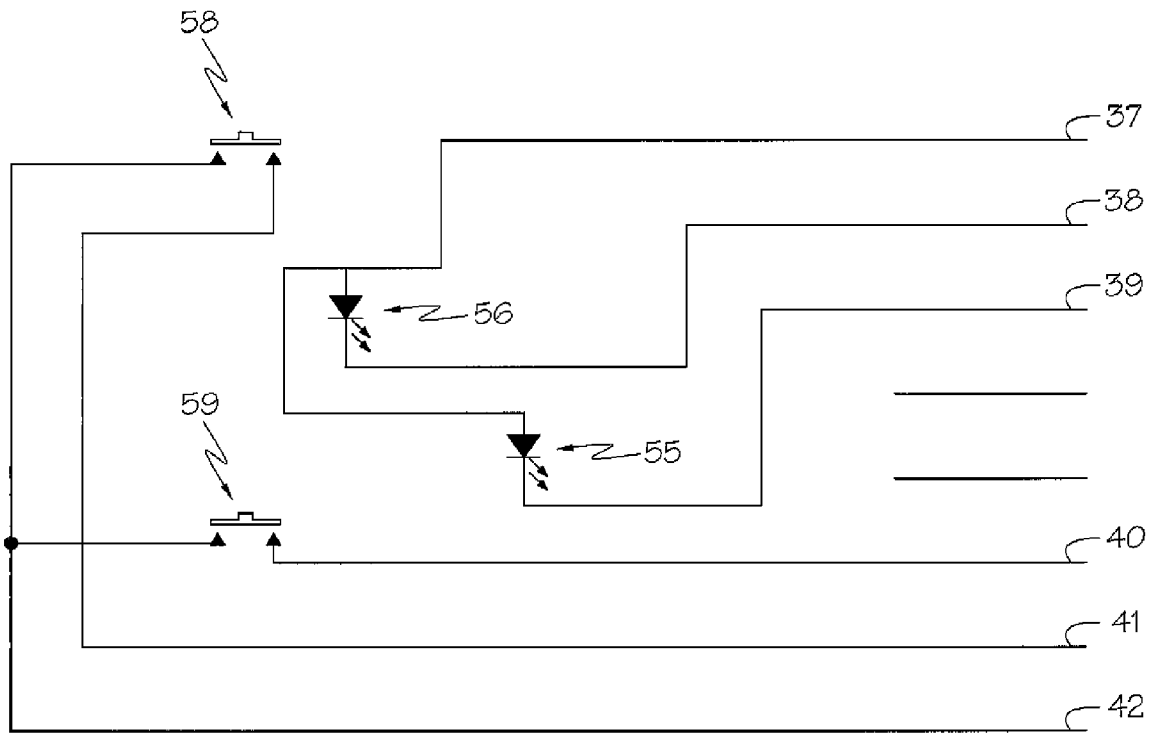
FIG. 4 shows the circuit diagram corresponding to the circuit board of the call panel faceplate membrane.

FIG. 4 shows the corresponding circuit diagram associated with the faceplate membrane electronics 22. The circuit consists of two switches, an upper push button switch 58 and a lower push button switch 59. As mentioned previously. The upper push button switch 58 is used to cancel the transmission of either an emergency or non-emergency message. The lower push button switch 59 is used to initiate the transmission of a non-emergency message. The inputs to both upper and lower switches are connected to input pin 42. The output of the upper switch is connected to the upper actuator output pin 41 while the output of the lower switch is connected to the lower actuator output pin 40. The circuit also contains a center LED 56 and a lower actuator LED 55. The anodes of both LEDs 55 and 56 are connected to the input pin 37. The cathode of the center LED 56 is connected to the center LED cathode I/O pin 38, while the cathode of the lower actuator LED 55 is connected to the lower actuator LED cathode 110 pin 39.

On the back of the call panel hosing, four legs extend outwards. These four legs support the main printed circuit board, which is secured to a leg on each corner of the board through a screw. The legs raise the circuit board from the back of the call panel housing such that a space is created behind the call panel housing. A push button switch extends from the main printed circuit board, into the call panel housing back space. A seesaw like member is attached to the middle of the panel on a protruding monolithic section of the back of the call panel. One end of the seesaw like member rests on top of the push button switch. The other end has an opening through it and rests on top of a spring. The spring is coiled about a hollow tubular protrusion that extends from the backside of the call panel housing and stops movement of the seesaw like member towards the back of the call panel housing. The pull cord is threaded from the front opening in the call panel membrane through the tubular protrusion and the opening in the seesaw member. The end of the pull cord is knotted, so that it does can not become unthreaded from the opening in the seesaw like member. Activation of the pull cord, causes the displacement of the seesaw like member such that the end with the opening moves toward the back of the call panel housing. The spring provides resistance against this movement. As the opening end of the seesaw like member moves toward the back of the call panel housing, the opposing end engages and subsequently activates the push button switch. This push button switch, in turn, triggers the sending of an emergency message to the nursing staff.

Figure 5:
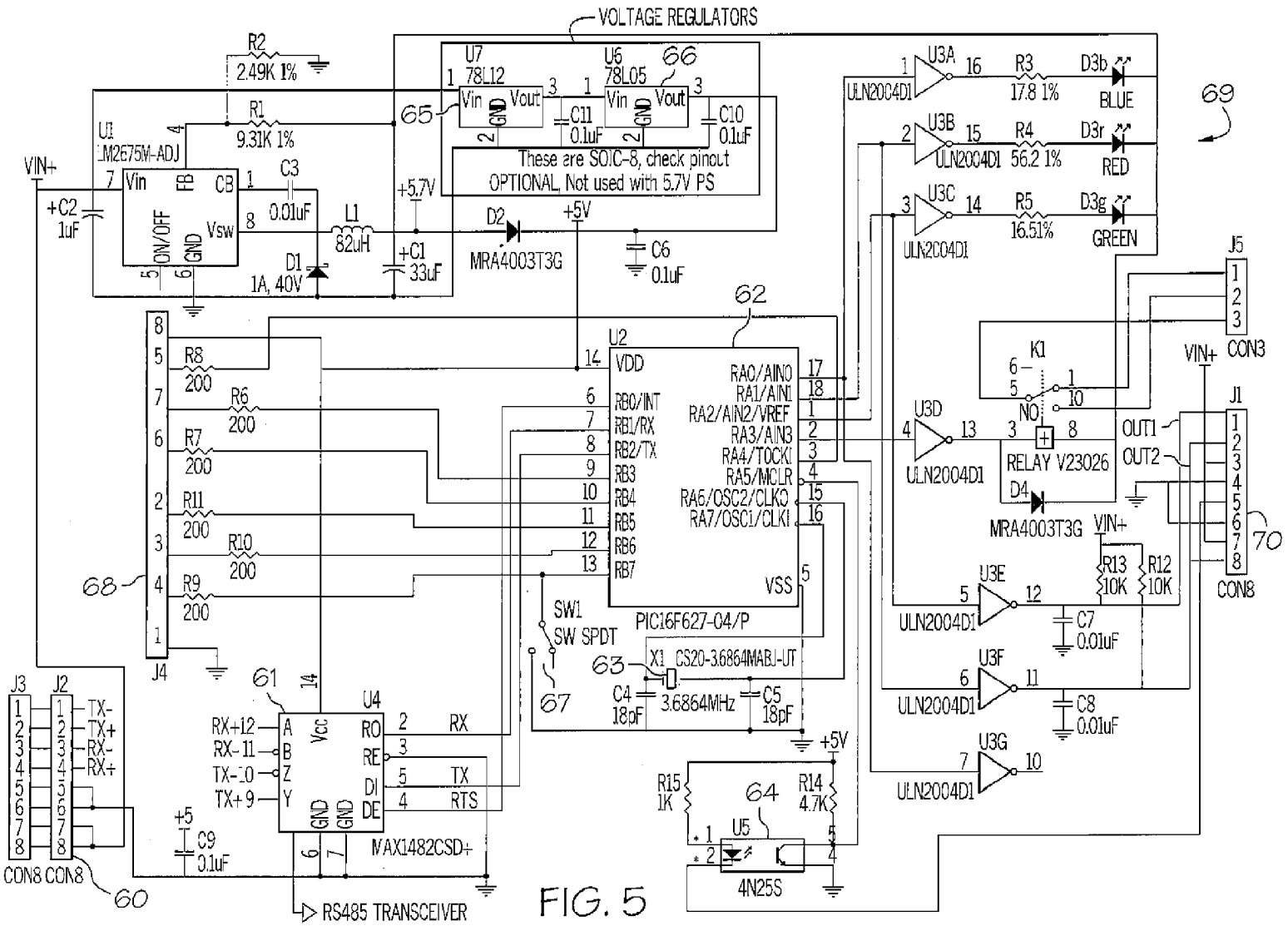
FIG. 5 shows the circuit diagram of the main printed circuit board of the device.

FIG. 5 shows the circuit diagram of the main printed circuit board 69. The circuit diagram includes two 8 pin data I/O jacks 60 that receive input and power from either CAT 5 or UTP cables. The data I/O jacks 60 serve as a wire to board means of transferring the signals from the UTP or CAT 5 cables directly to the PCB (printed circuit board) 69 or from the PCB back to the UTP or CAT 5 cables. The signals are sent through a RS485 serial communication method to a RS485 transceiver 61 located on the PCB 69. The RS485 transceiver outputs are connected to an 8-bit flash based CMOS microcontroller 62. The microcontroller 62 includes a watch dog timer function. An optocoupler is connected to optically isolate the remote input from the rest of the circuit. Two voltage regulators 65 and 66 are used to control the voltage within the integrated circuit.

A push button electromechanical switch 67 is controlled by the pull cord. Activation of the switch causes a ground signal corresponding to an emergency message to be sent to the microcontroller 62. The output from the call panel membrane circuit is connected to the main PCB 69 through the 8 pin connector 68. The output of the non-emergency actuator switch is connected to the microcontroller 62 at the same output terminal as the pull cord push button switch 67. Upon activation of the non-emergency actuator switch, a signal different from ground is sent to the microcontroller 62, thus telling the microcontroller 62 to send a non-emergency message. The "cancel" actuator switch is coupled to a different terminal of the microcontroller 62. Upon activation of the "cancel" actuator switch, the same signal as the non-emergency message signal is sent to the different terminal of the microcontroller 62, thus telling the microcontroller 62 to cancel the transmission of all messages being sent from the device within the hospital communication network. The microcontroller 62, subsequently sends corresponding to the activated message to the data output J1 70. J1 can be used in this application to connect a remote switch, such as a waterproof enclosure located in a shower. Additionally, data from J1 can connect to patient call boxes.

Figure 6:
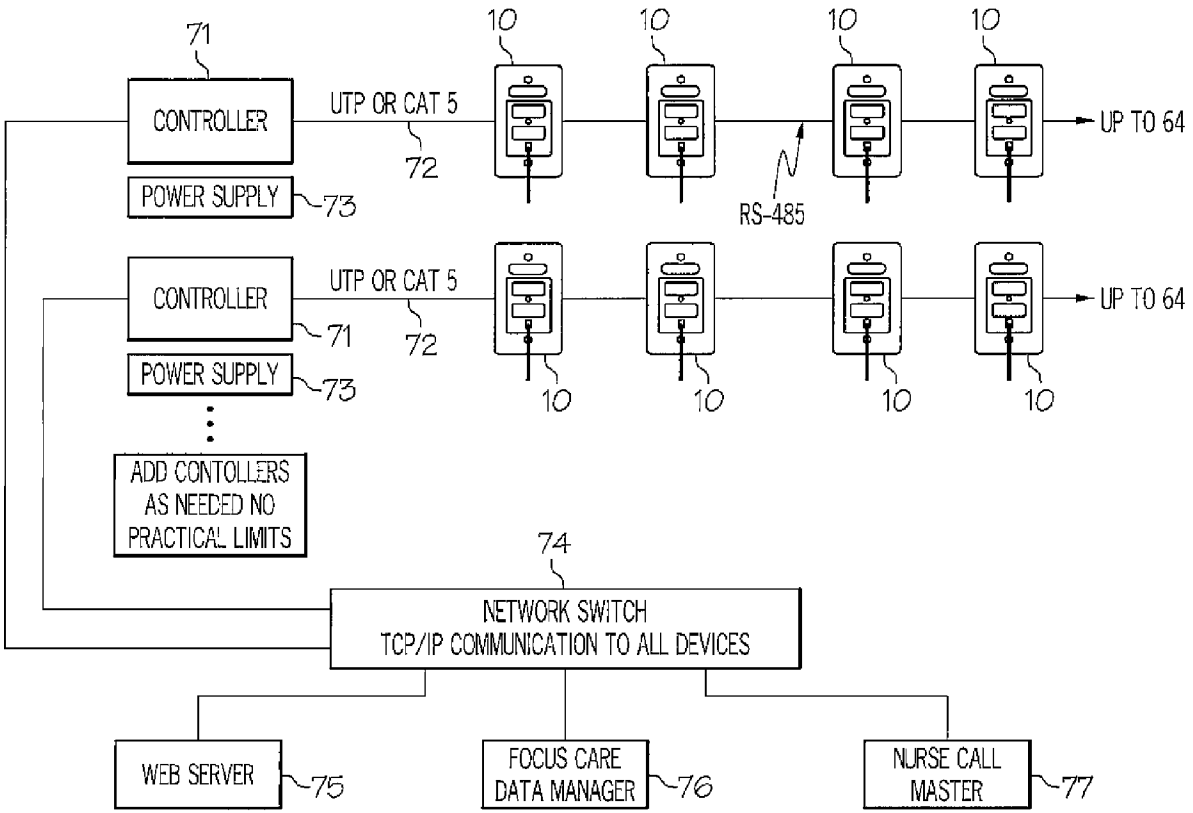
FIG. 6 shows the system architecture of multiple call panel devices integrated within a hospital communications network.

FIG. 6 shows the system architecture of various call panels integrated into a hospital communication network. In this system, multiple call panel devices 10 are connected in a daisy chain network configuration. The multiple call panel devices 10 are connected to the controller 71 through a RS-485 network. The advantageous of using a RS-485 network is a substantial reduction in the amount of noise present in the signals. This allows for signal communication from individual call panel devices 10 over larger distances and at faster speeds. Connections between the multiple call panel devices 10 and the multiple controllers 71 are made through either UTP or CAT 5 cables 72. A power supply 73 provides power to the each individual controller 71 and to each individual call panel 10 in the RS-485 network. The controllers 71 are connected to a network switch 74. The network switch 74 is coupled to a web server 75, a data manager XML database 76, and a nurse call master station 77. The web server 75, data manager XML database 76, and nurse call master station 77 are connected through the network switch 74 to the controller 71 through an IP based network. The information is sent between the controllers 71 in UDP data packets.

Figure 7:
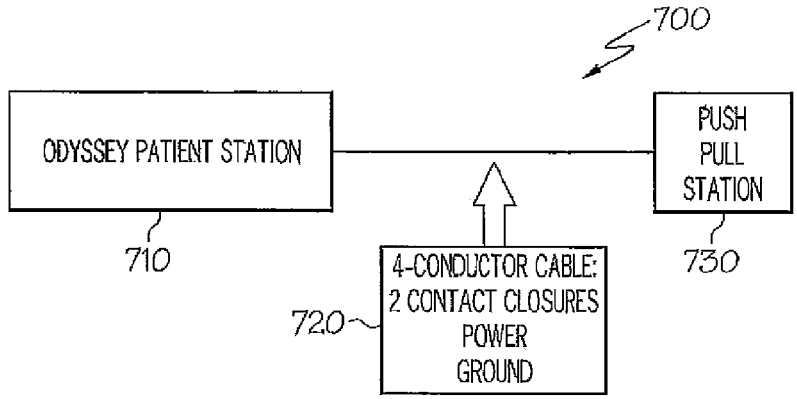
FIG. 7 shows an alternate system architecture of a call panel device integrated into a hospital communication network using an Odyssey(TM) Patient Station.

FIG. 7 shows the alternative system architecture 700 from that shown in FIG. 6; the figure illustrates a push pull station 730 integrated into a hospital communications network using an Odyssey™ Patient Station 710. The system architecture 700 illustrates the connection of the Patient Station 710 connection to the Push-Pull station 730 through the use of the four-conductor cable 720 (two contact closures, power and ground). Typically, one patient station 710 is connected to a single push-pull station 730 across cable 720. However, an alternative configuration permits two patient stations 710 (the second is not shown) being connected to a single push-pull station 730.

The Patient Stations 710 are located in the patient's rooms, providing patient(s) with a convenient means of originating calls to the nurse's station. When used with a paging system, calls can be routed directly to a patient's caregiver. The voice communication from the patient's room to the nurses' station is hands-free and two-way (duplex). Patient stations are capable of placing multiple types of calls including routine call, emergency call, code call, and two level locators. Remote devices can be connected to the patient station for additional call levels including the following: pillow speakers, toilet assist stations, Marc II™ intercom, bed-side communications, emergency call stations, room smoke detector, bed exit alarms, dome light, staff locations, code blue stations, code pink stations, IVAC alarm, TV theft alarm and heart monitors.

Figure 8:
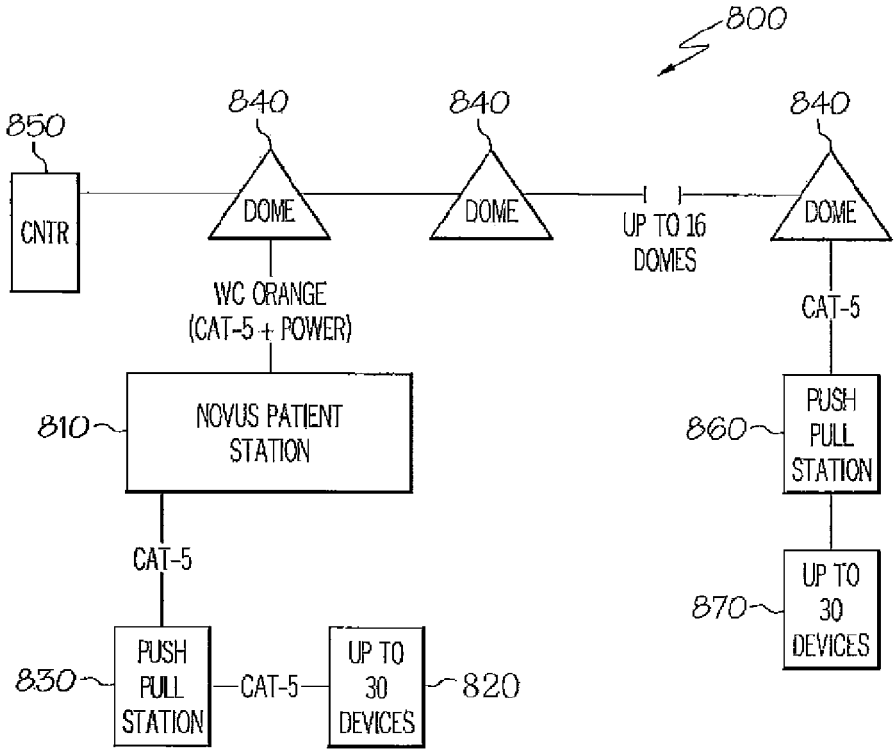
FIG. 8 shows an alternate system architecture of multiple directly connected call panel devices integrated into a hospital communication network using a Novus(TM) Patient Station.

FIG. 8 shows another alternative system architecture 800 from that of FIGS. 6-7; the figure illustrates multiple push pull stations 820, 830 integrated into a hospital communications network directly connected using a Novus™ Patient Station 810 and other push pull stations 860, 870 not connected via a patient station 810. Instead, these are connected to controller 850 through a dome light chain of at least one (but in most implementations a plurality of dome lights are envisioned) dome light 840. A controller 850 communicates upstream to other parts of the system architecture via an IP network (not shown) and through CAT 5 cabling or other suitable cabling (RS-485, UTP) to a dome light chain. The controller 850 organizes and executes the transmission and reception of information relating to the patient and room status, in other words, emergency and non-emergency data. Of course, the push-pull stations 860, 870 transmit and receive data to and from controller 850 directly through the dome light chain 840 using CAT 5 cabling or other suitable cabling (RS-485, UTP) and other push-pull stations 820, 830 send and receive data through the Patient Station 810.

Additionally, dome light's 840 are corridor dome lights that provide visual indications to notify staff members of a patient's and or room's status and are mountable on a wall or ceiling. The dome light's 840 are capable of being equipped with up to four sections with one incandescent lamp per section radiating different colors indicative of patient calls, patient waiting, staff calls, emergency, code blue, code pink and zone light applications. They are ordinarily arranged in a chain of from one to sixteen lights (but more are possible) 840 using CAT 5 cabling with each dome connected to either a push-pull station or Novus™ patient station; the chain begins with the first dome light directly connected to the controller 850, the succeeding dome light in the chain and the Patient Station 810.

The Patient Stations 810 are located in the patient's rooms, providing patient(s) with a convenient means of originating calls to the nurse's station. When used with a paging system, calls can be routed directly to a patient's caregiver. The voice communication from the patient's room to the nurses' station is hands-free and two-way (duplex). Patient stations are capable of placing multiple types of calls including routine call, emergency call, code call, and two level locators. Remote devices can be connected to the patient station for additional call levels including the following: pillow speakers, toilet assist stations, intercom system, bed-side communications, emergency call stations, room smoke detector, bed exit alarms, dome light, staff locations, code blue stations, code pink stations, IVAC alarm, TV theft alarm and heart monitors.

The instant invention has been shown and described herein in what is considered to be the most practical and preferred embodiments. It is recognized, however, that variations and departures may be made therefrom within the scope of the inventions and that obvious modifications will occur to a person of ordinary skill in the art.

What is claimed is:

1. A patient call device comprising:

means for housing a call panel membrane wherein the call panel membrane is integrated within the means for housing;

first actuator means for activating an emergency patient condition signal wherein the first actuator means passes through an aperture that is integrated within the call panel membrane;

second actuator means for activating a non-emergency patient condition signal wherein the second actuator means is integrated within the call panel membrane; and third actuator means for sending a patient cancellation signal wherein the third actuator means is integrated within the call panel membrane.

2. The patient call device of claim 1, wherein the first actuator means is a pull cord.

3. The patient call device of claim 2, wherein the first actuator means pull cord is further threaded through a hollow protrusion and on through an opening in a member whereupon it is knotted and wherein the member is associated with a spring device.

4. The patient call device of claim 1, further comprising:

an illumination means for signaling activation of an emergency or a non-emergency patient condition through the use of the first actuator means or the second actuator means respectively wherein the illumination means is integrated with the call panel membrane.

5. The patient call device of claim 4, wherein the illumination means is a light emitting diode.

6. The patient call device of claim 4, wherein the illumination means is situated above the first and second actuator means but below the third actuator means.

7. The patient call device of claim 1, further comprising:

an illumination means for lighting the second actuator means when a non-emergency signal has been activated wherein the illumination means is disposed underneath the second actuator means and integrated with a membrane panel circuit board.

8. The patient call device of claim 7, wherein the illumination means is a light emitting diode.

9. The patient call device of claim 1, further comprising:

armature means situated behind the second actuator means for receiving user input from the deformation of the second actuator means wherein the armature means moves towards a conductive region upon said deformation and makes electrical contact with the conductive region thereby forming a circuit and transmitting a patient non-emergency condition signal.

10. The patient call device of claim 9, further comprising:

a circuit board means for supporting the conductive region and facilitating the flow of current to signal the non-emergency condition to an external computing device.

11. The patient call device of claim 10, further comprising:

means for connection integrated with the circuit board means comprising multiple electrical channels for transmission and reception of signals.

12. The patient call device of claim 11, further comprising:

means for input electrical contact disposed on the circuit board means and connected to one of the multiple electric channels; and means for output electrical contact disposed on the circuit board means and connected to one of the multiple electrical channels wherein when the armature means makes electrical contact with the input and the output electrical contact means a signal is sent indicating the non-emergency condition to an external computing device.

13. The patient call device of claim 12, wherein the means for input electrical contact comprise one or more electrical contacts and the means for output electrical contact comprise one or more electrical contacts.

14. The patient call device of claim 12, further comprising:

means for adhering the circuit board means wherein the means for adhering is located opposite to the call panel membrane;

a spacer layer means disposed above the circuit board means for providing a space for the armature means to move towards the conductive region wherein a primary portion of the armature means moving through the spacer layer means is generally parallel to the plane of the spacer layer means and a secondary portion of the armature means is generally perpendicular to the plane of the spacer layer means;

a magnetic layer means above the space layer means for retracting the armature means from the conductive region once a user has caused the armature means to move towards the conductive region wherein the magnetic layer means comprises an opening for the secondary portion of the armature means to move through;

a retainer layer means for separating the magnetic layer from other components wherein the retainer layer is disposed above the magnetic layer wherein the retainer layer means further comprises an opening for the secondary portion of the armature means to move through; and an overlay layer means above the retainer layer for creating an armature chamber which houses a portion of the secondary portion of the armature means.

15. The patient call device of claim 1, further comprising:

armature means situated behind the third actuator means for receiving user input from the deformation of the third actuator means wherein the armature means moves towards a conductive region upon said deformation and makes electrical contact with the conductive region thereby forming a circuit and transmitting a patient cancellation condition signal.

16. The patient call device of claim 15, further comprising:

a circuit board means for supporting the conductive region and facilitating the flow of current to transmit the cancellation condition signal to an external computing device.

17. The patient call device of claim 16, further comprising:

means for connection integrated with the circuit board means comprising multiple electrical channels for transmission and reception of signals.

18. The patient call device of claim 17, further comprising:

means for input electrical contact disposed on the circuit board means and connected to one of the multiple electric channels; and means for output electrical contact disposed on the circuit board means and connected to one of the multiple electrical channels wherein when the armature means makes electrical contact with the input and the output electrical contact means a signal is sent indicating the cancellation condition to an external computing device.

19. The patient call device of claim 18, wherein the means for input electrical contact comprise one or more electrical contacts and the means for output electrical contact comprise one or more electrical contacts.

20. The patient call device of claim 18, further comprising:

means for adhering the circuit board means wherein the means for adhering is located opposite to the call panel membrane;

a spacer layer means disposed above the circuit board means for providing a space for the armature means to move towards the conductive region wherein a primary portion of the armature means moving through the spacer layer means is generally parallel to the plane of the spacer layer means and a secondary portion of the armature means is generally perpendicular to the plane of the spacer layer means;

a magnetic layer means above the space layer means and for retracting the armature means from the conductive region once a user has caused the armature means to move towards the conductive region wherein the magnetic layer means comprises an opening for the secondary portion of the armature means to move through;

a retainer layer means for separating the magnetic layer from other components wherein the retainer layer is disposed above the magnetic layer wherein the retainer layer means further comprises an opening for the secondary portion of the armature means to move through; and an overlay layer means above the retainer layer means for creating an armature chamber which houses a portion of the secondary portion of the armature means.

21. A patient call device communication network comprising:

controller means for communicating with at least one patient call means; and the patient call means for reception of user inputs and transmission of user signals to the controller means wherein the patient call means further comprises a non-emergency actuator means for activating a non-emergency signal and an emergency actuator means for activating an emergency signal, whereupon being activated, said non-emergency signal and emergency signal are each independently transmitted to a first terminal on said controller means.

22. The patient call device communication network of claim 21 further comprises:

a cancellation actuator means for sending a patient cancellation signal to the controller means, whereupon being activated, said cancellation signal, is transmitted to a second terminal on the controller means.

23. The patient call device communication network of claim 21 further comprises:

a plurality of patient call means for reception of user inputs and transmission of user signals to the controller means wherein each of the patient call means further comprises a non-emergency actuator means for activating a non-emergency signal and an emergency actuator means for activating an emergency signal.

24. The patient call device communication network of claim 21 further comprises:

a network switch means for bidirectional communication with the controller means and with a web server, a care data manager and a nurse call master.

25. The patient call device communication network of claim 21 wherein the controller means is a patient station.

26. The patient call device communication network of claim 25 further comprises:

a second controller means patient station connected to the same patient call means.

27. The patient call device communication network of claim 21 further comprises:

a dome light chain means of at least one dome light for connection of the patient call means to the controller means via cabling.

28. The patient call device communication network of claim 27 further comprises:

a patient station means situated between the dome light chain means and the patient call means for facilitating communication of the patient and or room status to the dome light chain means and the controller means wherein the patient station means, dome light chain means, controller means and patient call means are connected via cabling.

29. A medical network system comprising:

patient call means for signaling a patient or room condition comprising:

means for housing a call panel membrane wherein the call panel membrane is integrated within the means for housing;

first actuator means for activating an emergency patient condition signal wherein the first actuator means passes through an aperture that is within with the call panel membrane;

second actuator means for activating a non-emergency patient condition signal wherein the second actuator means is integrated within the call panel membrane; and third actuator means for sending a patient cancellation signal wherein the third actuator means is integrated within the call panel membrane;

armature means situated behind the second actuator means for receiving user input from the deformation of the second actuator means wherein the armature means moves towards a conductive region upon said deformation and makes electrical contact with the conductive region thereby forming a circuit and transmitting a patient non-emergency condition signal;

separate and distinct second armature means situated behind the third actuator means for receiving user input from the deformation of the third actuator means wherein the second armature means moves towards a conductive region upon said deformation and makes electrical contact with the conductive region thereby forming a circuit and transmitting a patient cancellation condition signal; and a controller means for communicating with the at least one patient call means.

* * * * *